US005722006A

United States Patent [19]

Watanabe

[11] Patent Number: 5,722,006

[45] Date of Patent: Feb. 24, 1998

[54] IMAGE FORMING APPARATUS CAPABLE OF COMPENSATING FOR INSTABILITY OF DENSITY DETECTING MEANS OUTPUT

[75] Inventor: Takahiro Watanabe, Tokyo, Japan

[73] Assignee: Canon Kabushiki Kaisha, Tokyo, Japan

[21] Appl. No.: 579,849

[22] Filed: Dec. 28, 1995

[30] Foreign Application Priority Data

Dec. 28, 1994 [JP] Japan ..... 6-337519

[51] Int. Cl.[6] ..... G03G 15/00; G03G 21/00

[52] U.S. Cl. ..... 399/49; 399/60; 399/72

[58] Field of Search ..... 355/203, 204, 355/205, 207, 208, 246; 399/46, 49, 60, 72

[56] References Cited

U.S. PATENT DOCUMENTS

| | | | |
|---|---|---|---|
| 5,045,883 | 9/1991 | Ishigaki et al. | 355/246 X |
| 5,253,018 | 10/1993 | Takeuchi et al. | 355/246 |
| 5,369,473 | 11/1994 | Ogawa et al. | 355/208 X |
| 5,481,337 | 1/1996 | Tsuchiya et al. | 355/208 |
| 5,559,587 | 9/1996 | Ogata et al. | 399/60 |

FOREIGN PATENT DOCUMENTS 02-149864 6/1990 Japan .

*Primary Examiner*—Matthew S. Smith

*Attorney, Agent, or Firm*—Fitzpatrick, Cella, Harper & Scinto

[57] ABSTRACT

An image forming apparatus includes a rotatable image bearing member for bearing a toner image and a toner image forming device for forming a toner image on said image bearing member. The toner image forming device is capable of forming a standard toner image and a plurality of reference toner images along a rotational direction of the image bearing member. The image forming apparatus also includes a density detecting device for detecting a density of the toner image on the image bearing member, a density control device for controlling the toner image forming device on the basis of an output of the detecting device from the standard toner image, a position detecting device for detecting a rotational angular position of the image bearing member, and a correcting device for correcting the density control device in accordance with an output of the density detecting device from the reference toner image, based on positional information of the position detecting device.

7 Claims, 6 Drawing Sheets

IMAGE FORMING APPARATUS CAPABLE OF COMPENSATING FOR INSTABILITY OF DENSITY DETECTING MEANS OUTPUT

FIELD OF THE INVENTION AND RELATED ART

The present invention relates to an image forming apparatus such as a copying machine, a printer, and the like, of the electrostatic recording type or the electro-photographic type.

In a conventional image forming apparatus of the electro-photographic type, or the electrostatic recording type, a two component system employing toner and carrier is used.

In this two component system, a toner image with a referential density level is formed on a photosensitive drum. When the detected density level of this toner image is sufficiently high, it is determined that the amount of toner is sufficient, and the toner is not replenished into a development device, and when the detected density level of the toner image is insufficient, it is determined that the amount of toner is insufficient, and the toner is replenished into the development device by an amount corresponding to the degree of insufficiency.

Therefore, the density sensor output in response to the referential density level must remain stable.

In the case of the conventional image forming apparatus, however, when the distance between the photosensitive drum surface and the toner density sensor varies, for example, when it increases, due to the eccentricity of the photosensitive drum, the toner density sensor determines that the toner density has decreased, and therefore, it reacts to increase the amount of the toner supply, increasing thereby the toner density. On the contrary, when the distance between the photosensitive drum surface and the toner density sensor decreases, the toner density sensor determines that the toner density has increased, and therefore, it does not react to replenish the toner, thereby reducing the toner density. In other words, the toner density is affected by the distance between the photosensitive member surface and the toner density sensor.

As is evident from the above description, the output of the toner density sensor is rendered unstable by the eccentricity of the photosensitive drum; the toner density sensor fails to accurately detect the toner density, creating a problem in that it is impossible to obtain a uniform toner density.

SUMMARY OF THE INVENTION

Accordingly, a primary object of the present invention is to provide an image forming apparatus capable of accurately detecting the toner density regardless of the magnitude of the photosensitive drum eccentricity.

According to an aspect of the present invention, there is provided an image forming apparatus comprising: a rotatable image bearing member for bearing an image; developing means for developing an electrostatic image on the image bearing member with toner; density detecting means for detecting a density of the toner image on the image bearing member; supply means for supplying toner in accordance with an output of the developing means from a toner supply control toner image; toner image forming means for forming a plurality of correction toner images, arranged in a direction of movement of periphery of the image bearing member; and correcting means for correcting the toner supply in accordance with the output of the detecting means, on the basis of outputs of the density detecting means.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Figure 2:
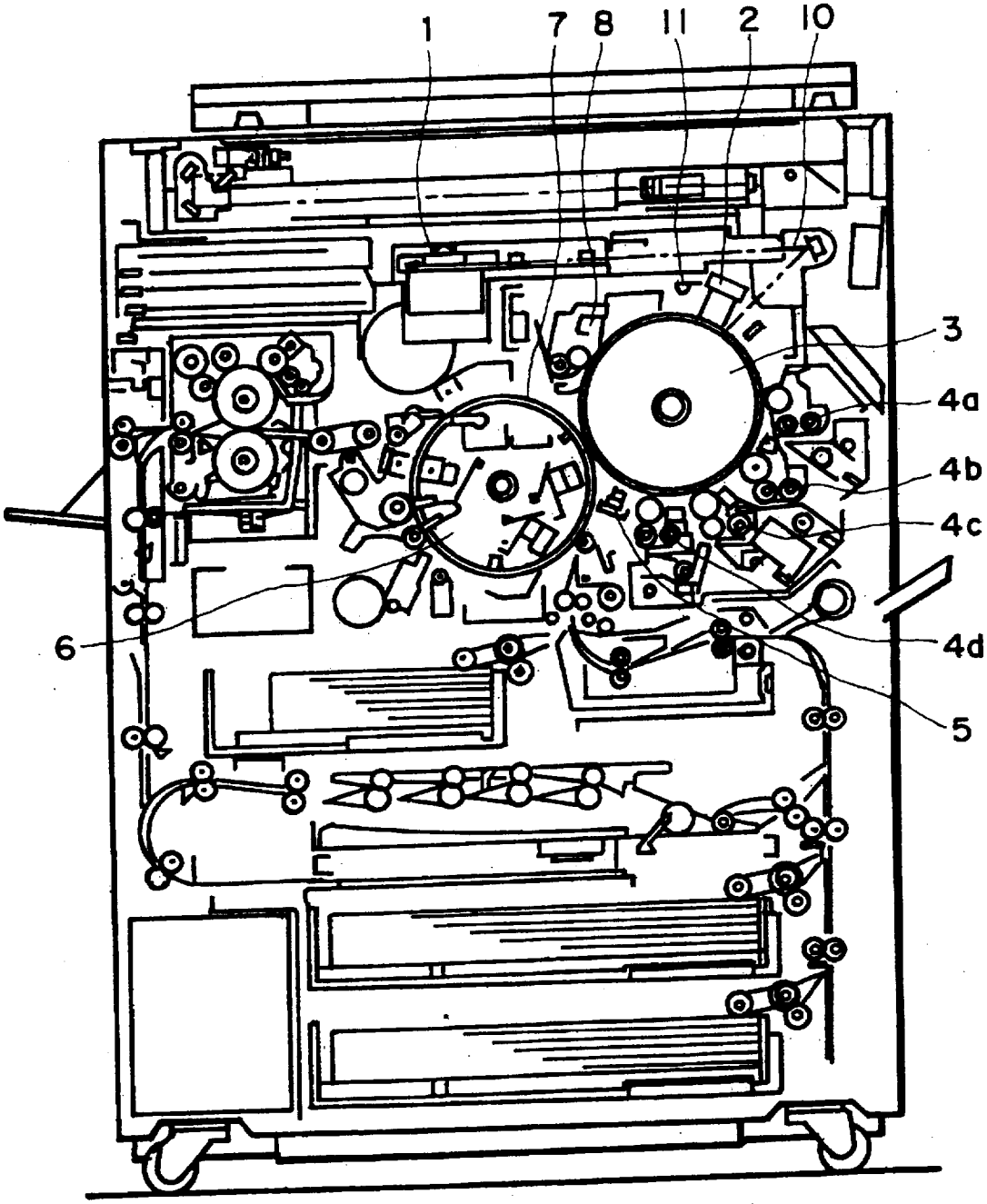
FIG. 2 is a sectional view of the image forming apparatus according to a second embodiment of the present invention.

FIG. 2 is a sectional view of a copying machine with a toner density sensor, that is, the image forming apparatus according to a preferred embodiment of the present invention. In the case of the apparatus illustrated in FIG. 2, a laser beam 10, which is modulated by the image signal sent from a reader section, is projected to a polygon mirror 1, and the laser beam 10 reflected by the polygon mirror 1 is projected to a photosensitive drum 3, the surface of which is charged by a charger 2. As a result, an electrostatic latent image is formed on the photosensitive drum 3. The electrostatic latent image is developed by magenta, cyan, yellow, and black development devices **4*a*–4*d***, using corresponding two component developers composed of toner and carrier.

Thereafter, the developed image is transferred onto a copy sheet 7 placed on a transfer drum 6. The residual toner on the photosensitive drum 3 is removed by a drum cleaner 8, and then, the residual charge on the photosensitive drum 3 is cleared by an exposure lamp 11 to prepare the photosensitive drum 3 for the next image formation.

A reference numeral 5 designates a density detection sensor for detecting the toner density on the photosensitive drum 3.

An electrostatic image, the potential of which corresponds to a referential density level, is formed on the photosensitive drum, and the density of the toner image obtained by developing this electrostatic image is detected by the density detection sensor 5.

Toner replenishment to the development devices is controlled in response to the detected density level of this toner image.

Figure 1:
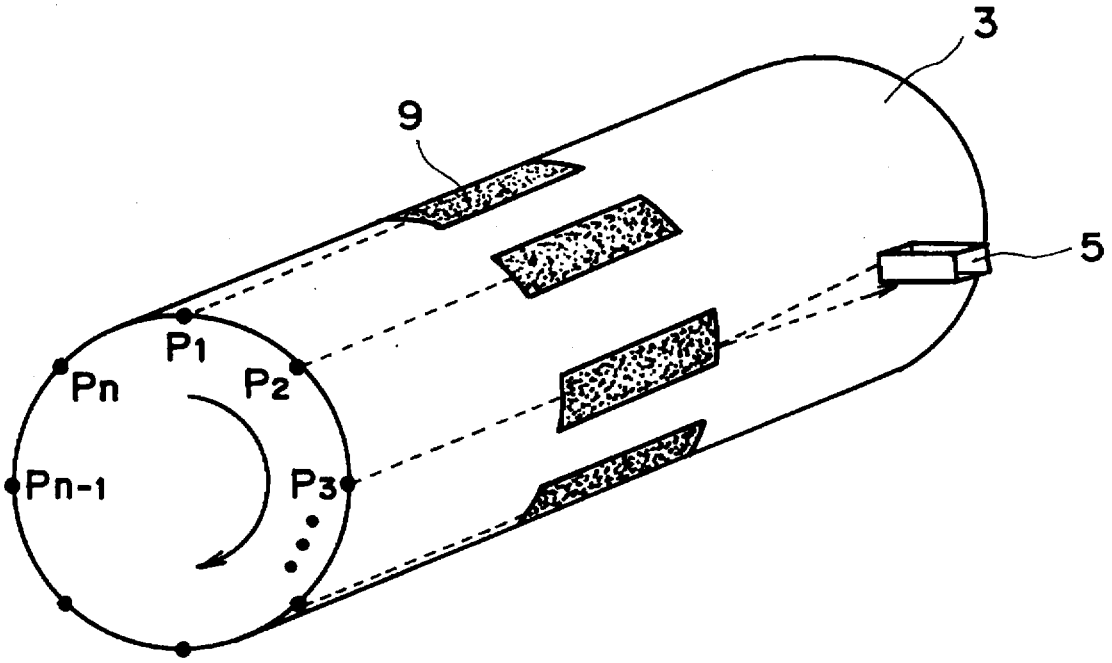
FIG. 1 depicts the locations of the plural referential images on the photosensitive drum, and the location of the toner density sensor, in the first embodiment.

Referring to FIG. 1, in this apparatus, n referential image formation spots P1–Pn are set up on the photosensitive drum 3. An image 9 with the referential toner density level is formed on each of the spots P1–Pn. As the photosensitive drum 3 is rotated, the toner density of the image 9 formed on each spot P is detected by the toner density sensor 5, the output value of which is K (0 V≦K≦5 V). The location of each referential image formation spot is recognize using the clock count equivalent to the rotational distance between the spot and a referential spot.

This toner density sensor output is converted to digital signal, the value of which is D (0≦D≦1023). Then, the converted values D1–Dn of the toner density sensor outputs, correspondent to the aforementioned n referential image formation spots P1–Pn, are stored, as the values representing the eccentricity of the photosensitive drum 3, in a storing means such as, a RAM.

Next, a function f(x) reflecting the characteristics of the A/D converted values D1–Dn of the toner density sensor outputs, correspondent to the referential image formation spots P1–Pn, is derived from the data stored in the aforementioned storing means.

[Equation 1]

$$D(x)=1023\times K(x)/5$$

[Equation 2]

$$f(x)=D(x)-(D1+D2+\ldots+Dn)/n$$

(D1+D2+. . . +Dn)/n is an average value of the converted values D1–Dn of the toner density sensor outputs, and this average value is employed as the referential value.

In this case, a function F(x) capable of cancelling the function f(x) derived as described above is:

[Equation 3]

$$F(x)=-\{D(x)-(D1+D2+\ldots+Dn)/n\}$$

Combining the function f(x) and F(x),

[Equation 4]

$$f(x)+F(x)=0$$

Figure 3:
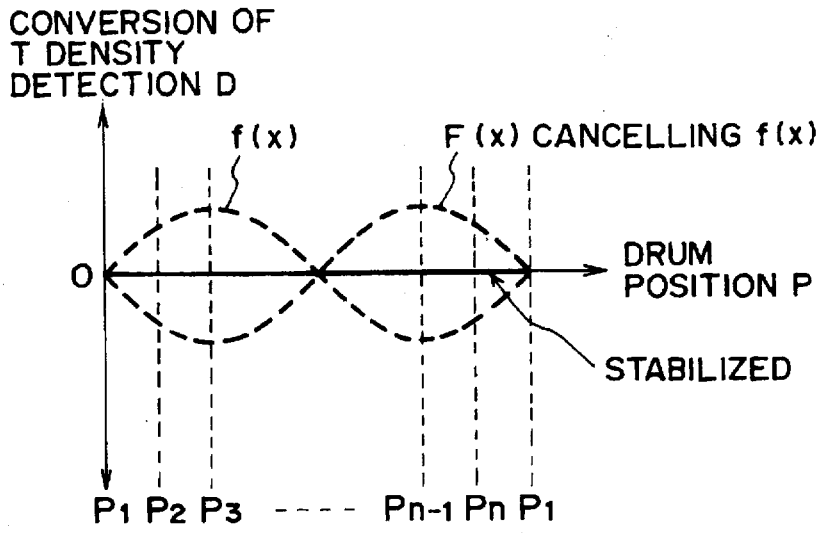
FIG. 3 is a graph obtained by plotting the results of: a function f(x)+a function F(x), in the first embodiment of the present invention.

In other words, the instability of the toner density sensor output due to the eccentricity of the photosensitive drum 3 is corrected using the function F(x), as illustrated in FIG. 3.

Next, the present invention will be described with reference to a specific case. In FIG. 1, n referential image formation spots P1–Pn are set up, and as the photosensitive drum 3 is rotated, the image 9 is formed on each spot.

When n is 8 (n=8), the referential image formation spots are P1–P8, and the image 9 is formed on each of the spots P1–P8. Then, the toner density of the image 9 on each of the spots P1–P8 is detected by the toner density sensor 5, obtaining the output values K1 (V)–K8 (V) of the toner density sensor 5. Also, the outputs (V) are converted to digital signals by a 10 bit A/D converter, obtaining the converted output values D1–D8 of the toner density sensor 5. Then, the converted output values D1–D8 of the toner density sensor 5 are stored, as the degree of eccentricity of the photosensitive drum 3, in the storing means in correspondence to the referential image formation spots P1–P8.

The f(x) reflecting the converted output values D1–D8 of the toner density sensor, correspondent to the referential image formation spots P1–P8, is derived from these data stored in the storing means as described above. When the toner sensor output values K1–K8 are as follows: K1=2.0 V; K2=2.2 V; K3=2.4 V; K4=2.2 V; K5=2.0 V; K6=1.8 V; K7=1.6 V; and K8=1.8 V, the converted output values D1–D8 obtained by the 10 bit A/D converter are as follows: D1=409.2; D2=450.12; D3=491.04; D4=460.12; D5=409.20; D6=368.28; D7=327.36; and D8=368.28. Consequently, the referential value is 409.2. Therefore, the function f(x) is:

[Equation 5]

$$f(x)=D(x)-409.2$$

Figure 4:
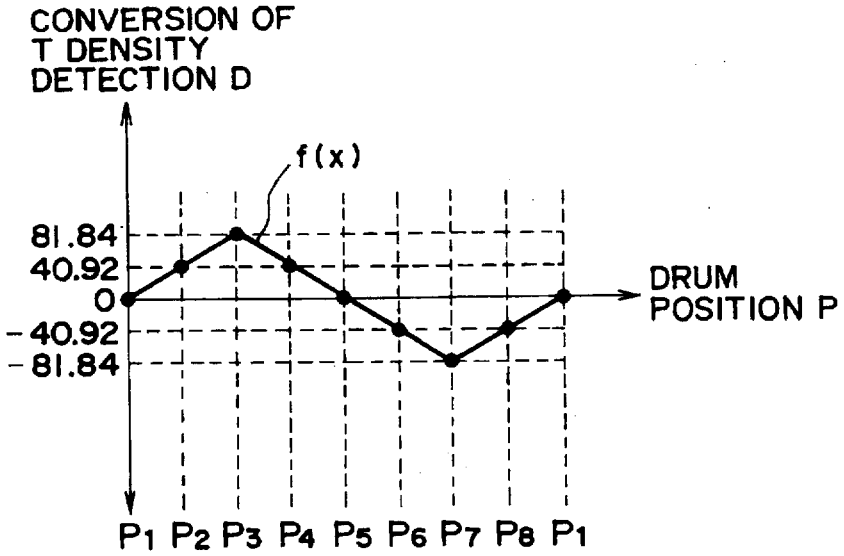
FIG. 4 is a graph of the function f(x) in the first embodiment.
Figure 5:
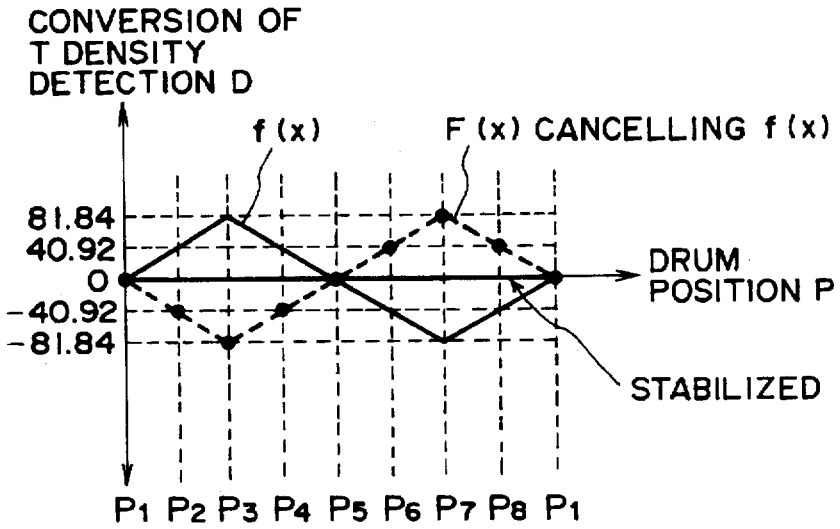
FIG. 5 is a graph of: a function f(x)+a function F(x), in the first embodiment of the present invention.

FIG. 4 is a graph of the function f(x) derived by the aforementioned computational means. In this graph, when a value Dx, that is, one of the converted output values D1–D8 of the toner density sensor, is larger than the referential value of 409.2, this means that the spot Px, that is, one of the correspondent referential image formation spots P1–P8, is displaced away from the toner density sensor due to the eccentricity of the photosensitive drum 3, whereas when a value Dx is smaller than the referential value of 409.2, this means that the correspondent spot Px is displaced toward the toner density sensor due to the eccentricity of the photosensitive drum 3. In this situation, the conventional image forming apparatus with the toner density sensor would have determined that the toner density was low at the referential image formation spots P2, P3 and P4, reacting to increase the toner supply, whereas at the referential image formation spots P6, P7 and P8, it would have determined that the toner density was high, refraining from replenishing the toner. In this embodiment, however, this function f(x) is combined with the function F(x):

[Equation 6]

$$F(x)=-D(x)+409.2$$

In order to compensate for the instability of the toner density sensor output, so that the output can be stabilized.

Figure 6:
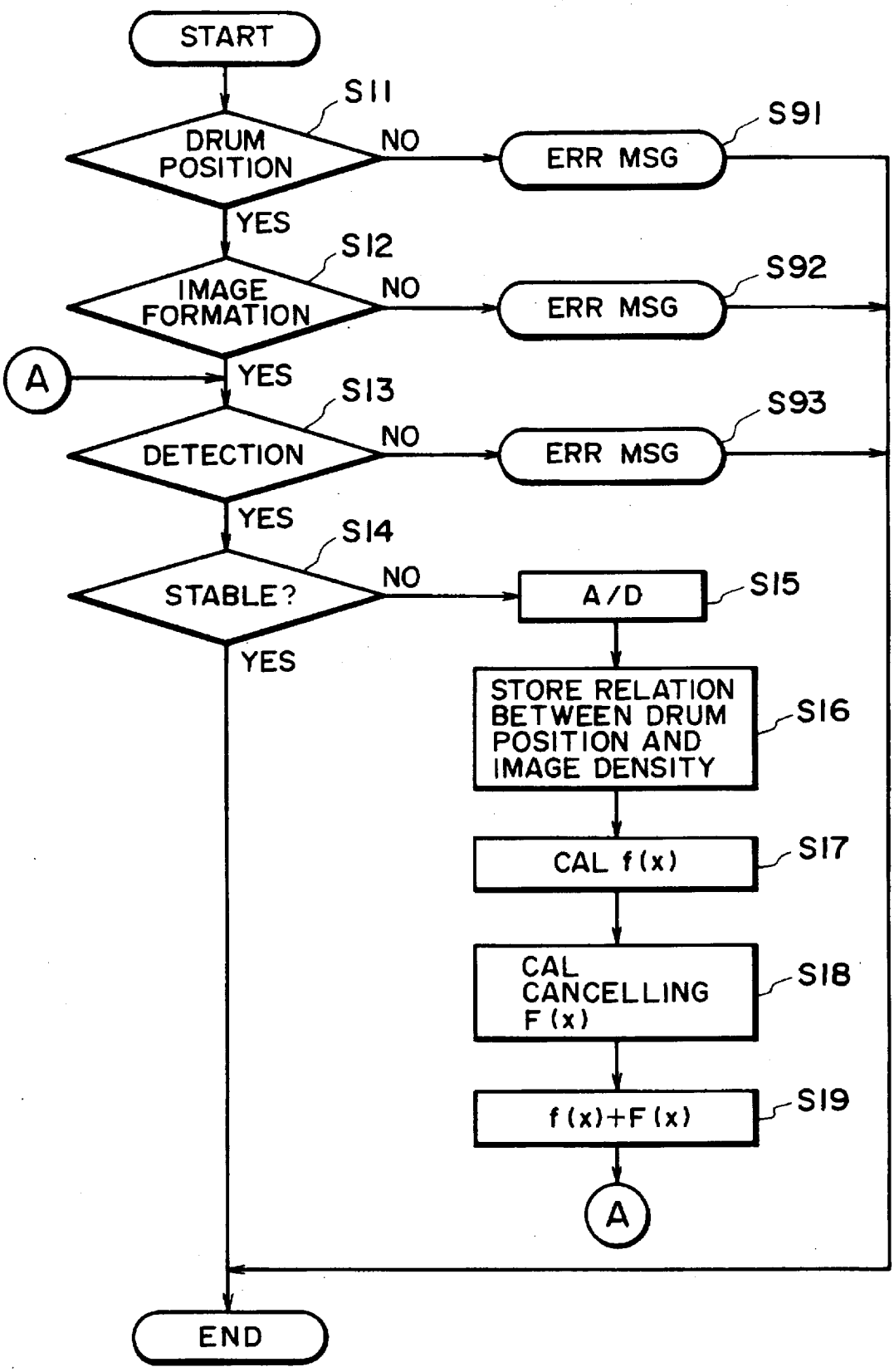
FIG. 6 is the flowchart in the first embodiment of the present invention.

Next, the control operation of this embodiment will be described with reference to the flowchart in FIG. 6. The timing for executing the control operation is optional; for example, it may be during the start-up, or immediately before an actual copying operation. First, it is checked whether or not the referential position of the photosensitive drum 3 is detected (step S11). When the referential drum position is detected, it is checked whether or not the image 9 is formed on the photosensitive drum 3 (step S12). When the image 9 is formed, it is checked whether or not the density of the image 9 is detected by the toner density sensor 5 (step S13). When the toner density is detected, it is checked whether or not the output of the toner density sensor 5 is stable (step S14).

When it is determined in each of the above step that the normal step is not carried out, the step is ended by displaying an appropriate error message indicating the cause for the anomaly (step S91, S92 and S93).

Next, the output is evaluated. When the output is stable, the compensating operation is ended without further action. When the output is not stable, the output is converted to a digital signal by the 10 bit A/D converter (step S15); the value D of the obtained digital signal (A/D converted value of the toner density sensor output) is stored in correspondence to the referential image formation spot P (step S16); and the function f(x) is derived from the stored data (step S17). Then, the function F(x) is derived (step S18). Next, the process: f(x)+F(x) is carried out (step S19) to compensate for the instability of the toner density sensor output due to the eccentricity of the photosensitive drum 3. Thereafter, the operation goes back to the toner density detection routine (step S13) to check whether or not the output is stabilized. When it is determined that the output is stable, the compensating operation is ended.

As is evident from the above description, according to the present invention, stable toner density can be obtained regardless of the eccentricity of the photosensitive drum.

As for the means for recognizing the locations of the referential image formation spots P1–Pn on the photosensitive drum 3, means such as a drum clock, which detects the rotational angle of the photosensitive drum, may be employed. As for the means for deriving the aforementioned functions, and compensating for the instability of the toner density sensor output, controlling means such as a CPU may be employed.

Embodiment 2

Also in this embodiment, n referential image formation spots P1–Pn are established on the photosensitive drum 3. As the photosensitive drum 3 is rotated, the image 9 is formed on each of the spot P1–Pn, and the density of the image 9 on each spot is detected by the toner density sensor 5, the output value of which is K (0 (V)≦K≦5 (V). The output is converted into digital signal by the 10 bit A/D converter or the like, and the value D of the digital signal (0≦D≦1023), or the values D1–Dn of the digital signals, which are the digitized values of the toner density sensor outputs K, are stored, as the degree of eccentricity of the photosensitive drum 3, in correspondence to the referential image formation spots P1–Pn. Then, an average value $D_{ave}$ of the digital signals D1–Dn is obtained using:

[Equation 7]

$$D(x)=1023\times K(x)/5$$

[Equation 8]

$$D_{ave}=(D1+D2+\ldots+Dn)/n$$

This average value $D_{ave}$ is employed as the referential value.

The referential value is stored in the storing means, and the toner density sensor 5 is feed-back-controlled based on this referential value deposited so that control data, which controls the amount of the toner to be adhered to the surface of the photosensitive drum 3 in correspondence to each of the referential image formation spots P1–Pn, are created from the stored referential values, and these data are fed back to the toner density sensor, so that the instability of the toner density sensor output due to the eccentricity of the photosensitive drum 3 can be corrected.

Next, this embodiment will be described with reference to a specific case. Also in this embodiment, the image 9 is formed on each of n referential image formation spots P1–Pn on the photosensitive drum 3 as the photosensitive drum 3 is rotated.

When n is eight (n=8), the referential image formation spots are P1–P8, and the image 9 is formed on each of the spots P1–P8. Then, the toner density of the image 9 on each spot is detected by the toner density sensor 5, the output values of which are K1–K8 (V). The toner density sensor outputs are converted to the digital signals, the values of which are D1–D8, which are stored as the values representing the eccentricity of the photosensitive drum 3, in correspondence to the referential image formation spots P1–P8.

When the toner sensor output values K1–K8 are as follows: K1=2.0 V; K2=2.2 V; K3=2.4 V; K4=2.2 V; K5=2.0 V; K6=1.8 V; K7=1.6 V; and K8=1.8 V, the digitized output values D1–D8 obtained by the 10 bit A/D converter are as follows: D1=409.2; D2=450.12; D3=491.04; D4=460.12; D5=409.20; D6=368.28; D7=327.36; and D8=368.28. Consequently, the referential value $D_{ave}$ is 409.2.

When a value Dx, that is, one of the digitized output values D1–D8 of the toner density sensor is larger than the referential value 409.2, this means that the spot Px, that is, one of the correspondent referential image formation spots P1–P8, is displaced away from the toner density sensor due to the eccentricity of the photosensitive drum 3, and when a value Dx is smaller than the referential value 409.2, this means that the correspondent spot Px is displaced toward the toner density sensor due to the eccentricity of the photosensitive drum 3.

Figure 7:
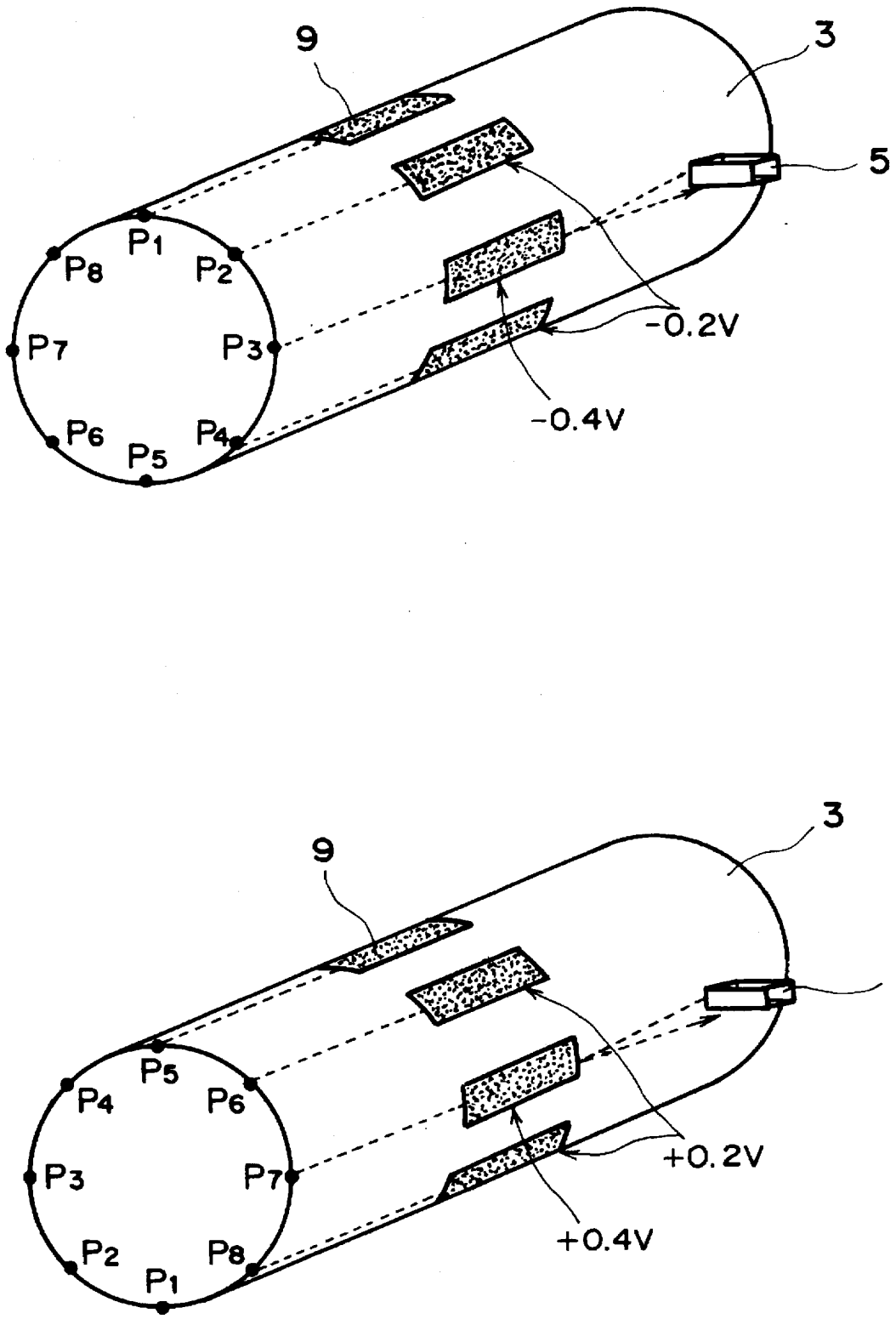
FIG. 7 depicts the effects of the feedback in the second embodiment of the present invention.

In this situation, the conventional image forming apparatus with the toner density sensor would have determined that the toner density was low at the referential image formation spots P2, P3 and P4, reacting to increase the toner supply, whereas at the referential image formation spots P6, P7 and P8, it would have determined that the toner density was high, refraining from replenishing the toner. In this embodiment, however, control data for controlling the amount of the toner to be adhered to the surface of the photosensitive drum 3 in correspondence to each of the referential image formation spots P1–P8 as shown in FIG. 7 are created from the stored data, and these control data are fed back to the toner density sensor 5, so that the instability of its output can be corrected. More specifically, the control correspondent to each of the spots P1–P8 is executed as described below.

Figure 8:
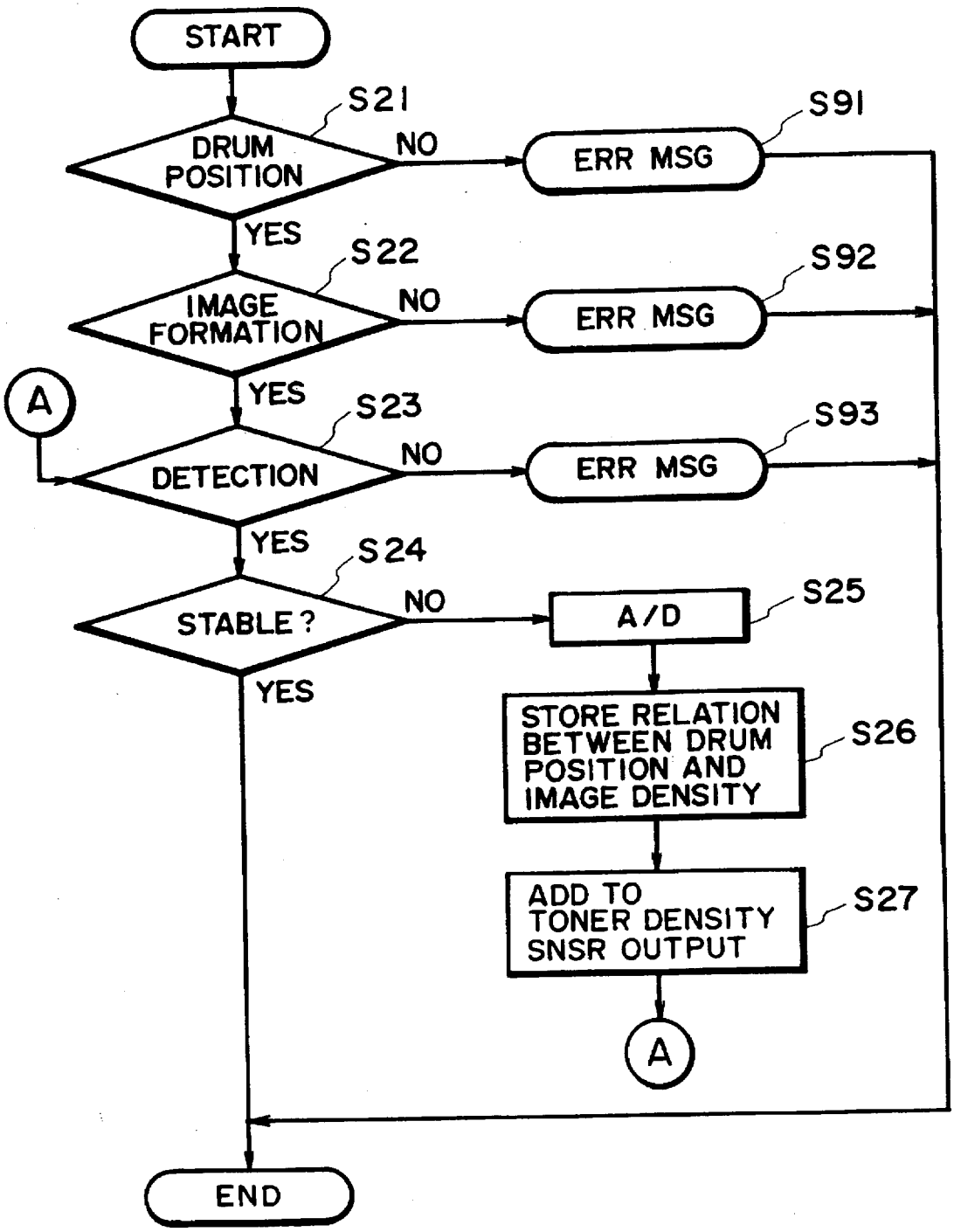
FIG. 8 is the flowchart in the second embodiment of the present invention.

P1, P2: no control is executed since f(1) and f(2) are the same as the referential value;

P2, P4: control is executed by feeding back a datum, equivalent to −0.2 V, to the toner density sensor 5 since f(2) and f(4) are 40.92 larger than referential value;

P3: control is executed by feeding back a datum, equivalent to −0.4 V, to the toner density sensor 5 since f(3) is 81.84 larger than the referential value;

P6, P8: control is executed by feeding back a datum, equivalent to 0.2 V, to the toner density sensor 5 since f(6) and f(8) are 40.92 smaller than the referential value;

P7: control is executed by feeding back a datum, equivalent to 0.4 V, to the toner density sensor 5 since f(7) is 81.84 smaller than the referential value Next, the control operation of this embodiment will be described with reference to the flowchart in FIG. 8. The timing for executing the control operation is optional; for example, it may be during the start-up, or immediately before an actual copying operation. First, it is checked whether or not the referential position of the photosensitive drum 3 is detected (step S21). When the referential drum position is detected, it is checked whether or not the image 9 is formed on the photosensitive drum 3 (step S22). When the image 9 is formed, it is checked whether or not the density of the formed image 9 is detected by the toner density sensor 5 (step S23). When the toner density is detected, it is checked whether or not the output is stable (step S24).

When it is determined in each of the above steps that the normal step is not carried out, the step is ended by displaying an appropriate error message indicating the cause for the anomaly (step S91, S92 and S93).

Next, the output of the toner density sensor 5 is evaluated. When it is stable, the control (compensating) operation is ended without further action. When not stable, the output is converted to digital signal by the 10 bit A/D converter (step S25); the value D of the obtained digital signal (A/D converted output values of the toner density sensor) is stored in correspondence to the positional information of the referential image formation spot P (step S26). Then, data set up for varying the amount of the toner to be adhered to the surface of the photosensitive drum 3, in correspondence to the referential image formation spots P1–Pn, are fed to the toner density sensor 5 (step S27), compensating for the instability of the output of the toner density sensor due to the eccentricity of the photosensitive drum 3. Thereafter, the operation goes back to the toner density detection routine (step S23) to check whether or not the output K is stabilized. When it is determined that the output is stable, the compensating operation is ended.

As described above, also in this embodiment, stable toner density can be obtained.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

a rotatable image bearing member for bearing a toner image;

toner image forming means for forming a toner image on said image bearing member, wherein said toner image forming means is capable of forming a standard toner image and a plurality of reference toner images along a rotational direction of said image bearing member;

density detecting means for detecting a density of the toner image on said image bearing member;

density control means for controlling said toner image forming means on the basis of an output of said detecting means from said standard toner image;

position detecting means for detecting a rotational angular position of said image bearing member; and correcting means for correcting said density control means in accordance with an output of said density detecting means from the reference toner image, based on positional information of said position detecting means.

2. An apparatus according to claim 1, wherein said toner image forming means forms the standard toner image at a predetermined position on said image bearing member in accordance with the positional information of said position detecting means.

3. An apparatus according to claim 2, further comprising storing means for storing the outputs of said density detecting means from the plurality of the reference toner images.

4. An apparatus according to claim 3, wherein said correcting means calculates a function representative of the relation between the position information of said image bearing member and the outputs of said density detecting means from the plurality of the reference toner images and a reciprocal function thereof.

5. An apparatus according to claim 1, wherein said correcting means corrects the output of said density detecting means.

6. An apparatus according to claim 1, wherein said image bearing member is in the form of a drum.

7. An apparatus according to claim 1, wherein said image bearing member has a photosensitive member, and said toner image forming means comprises a charger for charging said image bearing members, an exposure device for exposing said image bearing member to form an electrostatic latent image, a developing device for developing the electrostatic latent image, and a toner supplying device for supplying toner into said developing device, wherein said density control means controls an amount of the toner supplied to said developing device from said supplying device.

* * * * *

UNITED STATES PATENT AND TRADEMARK OFFICE

CERTIFICATE OF CORRECTION

PATENT NO. : 5,722,006

DATED : February 24, 1998

INVENTOR(S) : TAKAHIRO WATANABE

It is certified that error appears in the above-identified patent and that said Letters Patent is hereby corrected as shown below:

Column 3

Line 2, "recognize" should read --recognized--.

Column 6

Line 36, "value;" should read --value; and--; and
Line 39, "value" should read --value.--.

Column 8

Line 9, "claim 2," should read --claim 1,--.

Signed and Sealed this

Thirteenth Day of October 1998

Bruce Lehman

*Attest:*

BRUCE LEHMAN

*Attesting Officer*

*Commissioner of Patents and Trademarks*